US009988788B2

(12) United States Patent
Holt et al.

(10) Patent No.: US 9,988,788 B2
(45) Date of Patent: Jun. 5, 2018

(54) VACUUM-EXCAVATION APPARATUS

(71) Applicant: TKS INDUSTRIES LTD., Lacombe (CA)

(72) Inventors: Tim Holt, Red Deer (CA); Theresa Stec, Jarvis Bay (CA); Joshua Rosvold, Calgary (CA); Joshua Abbott, Chestermere (CA)

(73) Assignee: TKS Industries Ltd., Lacombe, Alberta (CA)

( * ) Notice: Subject to any disclaimer, the term of this patent is extended or adjusted under 35 U.S.C. 154(b) by 0 days. days.

(21) Appl. No.: 15/265,519

(22) Filed: Sep. 14, 2016

(65) Prior Publication Data

US 2018/0073216 A1 Mar. 15, 2018

(51) Int. Cl.

| | |
|---|---|
| ***A47L 5/00*** | (2006.01) |
| ***E02F 3/88*** | (2006.01) |
| *E02F 5/00* | (2006.01) |

(52) U.S. Cl.

CPC ..... *E02F 3/8816* (2013.01); *E02F 5/003* (2013.01)

(58) Field of Classification Search

CPC ..... E02F 3/8816; E02F 5/003; E01H 1/0836; E01H 1/0827; A47L 2201/00

See application file for complete search history.

(56) References Cited

U.S. PATENT DOCUMENTS

| | | | | | |
|---|---|---|---|---|---|
| 3,150,404 | A * | 9/1964 | Johnson | E03F 7/10 | 15/339 |
| 4,199,837 | A * | 4/1980 | Fisco, Jr. | E03F 7/10 | 134/168 C |
| 4,227,893 | A * | 10/1980 | Shaddock | B60P 1/60 | 15/340.1 |
| 4,322,868 | A * | 4/1982 | Wurster | E03F 7/10 | 134/168 C |
| 4,525,277 | A * | 6/1985 | Poulin | E03F 7/10 | 137/267 |
| 4,578,840 | A * | 4/1986 | Pausch | E01H 1/0836 | 15/340.1 |
| 4,669,145 | A * | 6/1987 | Kehr | B65H 75/425 | 134/166 C |
| 4,922,571 | A * | 5/1990 | Driear | E03F 7/10 | 134/168 C |
| 4,935,984 | A * | 6/1990 | Bryant | E03F 7/10 | 134/167 C |

(Continued)

*Primary Examiner* — Dung Van Nguyen

(74) *Attorney, Agent, or Firm* — Gowling WLG (Canada) LLP

(57) ABSTRACT

The present disclosure describes a vacuum-excavation apparatus that is connectible to a vehicle. The vacuum-excavation apparatus comprises a vacuum tube with an input end; a vacuum assembly for generating a suction force at the input end and drawing a stream of fluidized debris-material into the vacuum tube. The apparatus also includes a boom assembly for supporting the vacuum tube and a tank for receiving the stream of fluidized debris-material from the vacuum tube. The tank provides a boom mount for pivotally connecting the boom assembly and for providing fluid communication between the vacuum tube and the tank. The apparatus also includes an evacuation tube for providing fluid communication between the tank and the vacuum assembly and for distributing at least a portion of stress-loads that are generated by the boom assembly.

12 Claims, 5 Drawing Sheets

(56) References Cited

U.S. PATENT DOCUMENTS

| | | | | | |
|---|---|---|---|---|---|
| 5,030,259 | A * | 7/1991 | Bryant | B01D 50/002 | 15/340.1 |
| 5,062,868 | A * | 11/1991 | Kennedy | B60P 1/60 | 15/340.1 |
| 5,577,772 | A * | 11/1996 | Kaiser | E03F 7/10 | 137/355.12 |
| 6,438,792 | B1 * | 8/2002 | Cappellotto | E03F 7/10 | 15/302 |
| 6,942,717 | B2 * | 9/2005 | Armstrong | B01D 46/0068 | 55/302 |
| 2005/0166350 | A1 * | 8/2005 | Buckner | B60P 1/60 | 15/312.2 |

* cited by examiner

VACUUM-EXCAVATION APPARATUS

TECHNICAL FIELD

This disclosure generally relates to excavation. In particular, the disclosure relates to an apparatus for vacuum-excavation.

BACKGROUND

Vacuum excavation uses pressurized streams of fluids to dig a hole, a pit, a trench or a trough by loosening debris material such as soil, rocks and other materials. The loosened debris-materials are then pneumatically collected and removed by a vacuum system. Vacuum excavation can expose buried facilities without the risk of damage that may arise by digging with shovels or other heavy equipment.

Typically, vacuum-excavation apparatuses are transported upon large vehicles, such as trucks. The trucks can carry liquid-pressurization or pneumatic equipment, vacuum equipment and large tanks for containing the excavated soil, rocks and other materials. Booms are typically connected to the top of the tanks to connect a vacuum hose to the tank. The boom allows the user to move an input end of the vacuum hose about the truck during excavation operations. Due to the weight of this equipment, the mass of the excavated materials and the stress loads imparted by moving the swing boom about, the tanks are typically made up of steel with ¼ inch to ½ inch thick walls. A stress load may also be referred to as a mechanical stress. Furthermore, many tanks have thick walls or further physical reinforcements, such as extension members, that are connected to the tank to accommodate the stress loads imparted upon the tank by the moving boom. In other examples of vacuum trucks, the swing boom can have a separate support-structure that connects the swing boom directly to the vacuum truck.

In order to accommodate the weight associated with the tanks and the further physical reinforcements or separate support-structure, a typical vacuum-truck has two or three rear-axles. While the trucks with multiple rear-axles can support the weight of the vacuum-excavation apparatus and can carry heavy loads of debris materials within the tank, these trucks have limited maneuverability, low fuel-efficiency and can cause damage to roadways. Furthermore, many jurisdictions require a specialized operator's license to operate trucks with multiple rear-axles.

SUMMARY

Some embodiments of the present disclosure relate to a vacuum-excavation apparatus. The apparatus comprises a vacuum assembly, a tank and a boom assembly that is pivotally connectible to the tank by a boom mount. The boom mount is coupled to the tank, for example by one or more support members. The tank further comprises an evacuation pipe that is coupled to the boom mount and coupled to the tank, for example by one or more further support members. The evacuation pipe is in fluid communication with the interior of the tank and it directs the evacuation fluid towards a vacuum assembly that is downstream of the tank.

Some embodiments of the present disclosure relate to a tank for use with a vacuum-excavation apparatus. The tank comprises a boom mount that is coupled to the tank, for example by one or more support members. The tank further comprises an evacuation pipe that is coupled to the boom mount and to the tank by one or more further support members. The evacuation pipe is in fluid communication with the interior of the tank and it is configured to direct an evacuation fluid stream towards a vacuum assembly that is downstream of the tank. The evacuation pipe and the one or more further supports are configured to assist in distributing stress-loads that are imparted upon the boom mount and the tank by a boom assembly, or movement thereof, that is connected to the boom mount. A stress load may also be referred to herein as a mechanical stress.

Without being bound by any particular theory, the inventors have found that coupling the boom mount to either or both of the rear header of the tank and the evacuation pipe distributes at least a portion of the stress loads imparted by the boom-assembly. In particular, at least a portion of the stress-loads are distributed areas where the support members are coupled to the rear header. The stress-loads are also distributed to the where each of the further support members are coupled to the tank. Due to this distribution of at least a portion of the stress loads, some or all of the tank can be made with a thinner wall. Thinner tank walls decreases the overall weight of the tank as compared to a typical vacuum-truck tank. Distributing at least a portion of the stress loads avoids the necessity of further boom-supporting structures, which also decreases the overall weight of the vacuum-evacuation apparatus as compared to a typical vacuum-truck tank. Furthermore, further fluid conduction members between the tank and the vacuum assembly are not necessary, which also decreases the overall weight of the vacuum-excavation apparatus. These features contribute towards a vacuum-excavation apparatus that is light enough to be supported by a vehicle with a single rear-axle chassis.

BRIEF DESCRIPTION OF THE DRAWINGS

Features of the embodiments of the present disclosure will become more apparent in the following detailed description in which reference is made to the appended drawings.

DETAILED DESCRIPTION

Embodiments of the present disclosure will now be described by reference to FIG. 1 to FIG. 5, which show representations of a vacuum-excavation apparatus.

Figure 1:
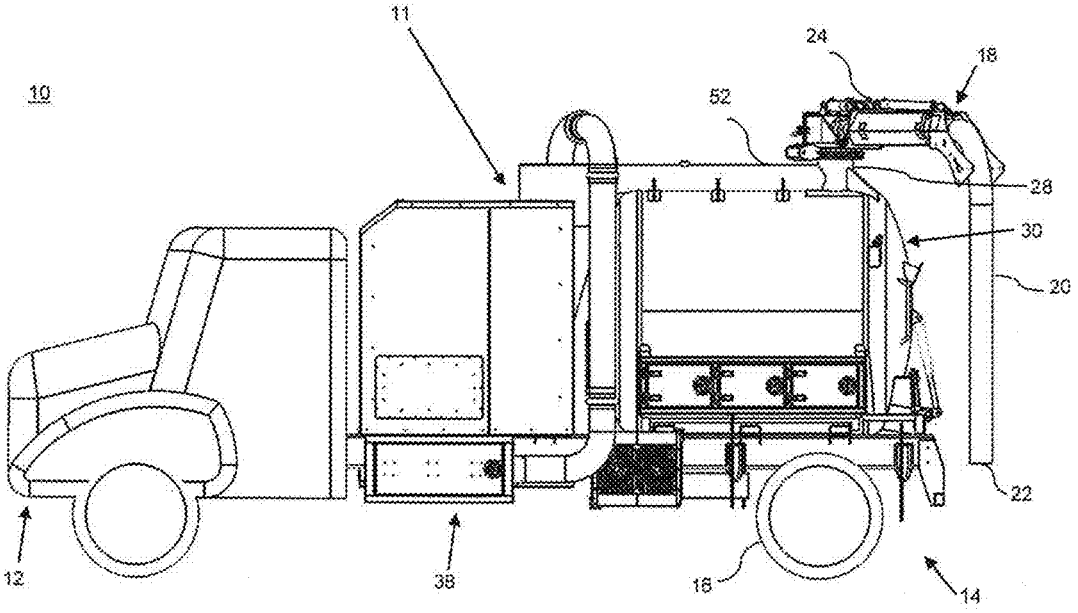
FIG. 1 is a side-elevation view of a vacuum-excavation apparatus that is fixed upon a vehicle, according to one embodiment of the present disclosure.

FIG. 1 shows a vehicle 10 that can support one embodiment of the present disclosure that relates to a vacuum-excavation apparatus 11. The vacuum-evacuation apparatus 11 comprises various components including a boom assembly 18, a tank 30 and a vacuum assembly 38. The vehicle 10 may be a truck with a chassis that has one or more rear-axles. In some embodiments of the present disclosure, the truck 10 has a single rear-axle.

The boom assembly 18 comprises a vacuum tube 20 and a support arm 24. The vacuum tube 20 has an input end 22 that is in fluid communication with other sections of the vacuum-excavation apparatus 11. The support arm 24 is pivotally connectible to the tank 30. The support arm 24 supports the vacuum tube 20 so that the input end 22 can be positioned adjacent material to be excavated during excavation operations in the vicinity of the vehicle 10. As described further below, the input end 22 is fluidly connected to the vacuum assembly 38 so that during excavation operations materials such as rocks, soil, ice and other debris, collectively debris materials, are fluidized, sucked into the input end 22 and conducted to other sections of the vacuum-excavation apparatus 11. In some embodiments of the present disclosure the boom assembly 18 weighs between about 550 pounds and about 650 pounds (one pound is equivalent to about 0.454 kilograms). During excavation operations when debris material is conducted through the vacuum tube 20, the boom assembly 18 may impart loads of up to 1100 pounds, which may be inclusive of any operator contribution that occur during excavation operations. In some embodiments of the present disclosure the boom assembly 18 may also be extendible and retractable to increase the distance that the input end 22 can reach. The support arm 24 may have a retracted length of about 10 feet and an extended length of about 18 feet. In some embodiments of the present disclosure, the support arm 24 has a retracted length of about 12 feet and an extended length of about 16 feet. The boom assembly 18 and movement thereof impart stress loads on the tank 30. A stress load may also be referred to herein as a mechanical stress. As will be discussed further below, embodiments of the present disclosure distribute at least a portion of these stress-loads to various structures and locations of the tank 30. This distribution of at least a portion of the stress loads allows the tank 30 to be constructed of less material and, therefore, to have a lighter overall weight.

Figure 2:
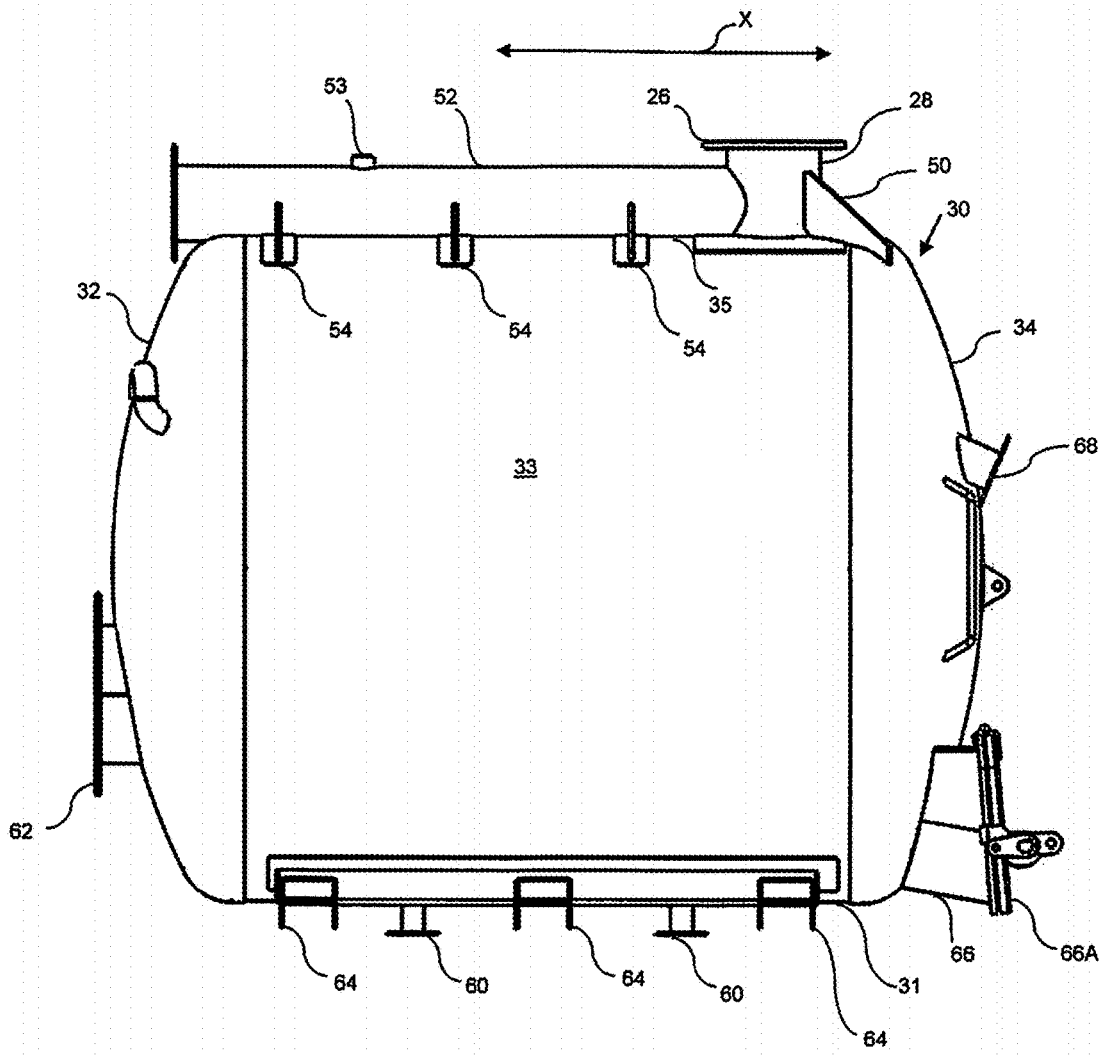
FIG. 2 is a side-elevation view of a tank for use with the vacuum-excavation apparatus of FIG. 1, according to one embodiment of the present disclosure.

FIG. 2 shows one embodiment according to the present disclosure that relates to the tank 30. The tank 30 is made up of one or more walls made of a rigid material, for example A36 steel, high-strength steel and aluminium. The tank 30 comprises a front header 32, a middle section 33 and a rear header 34 all of which define a tank space 30A therein. The front header 32 and the rear header 34 define a longitudinal axis of the tank 30, shown as X in FIG. 2 and FIG. 3A. The tank 30 also has a lower surface 31 and an upper surface 35.

In some embodiments of the present disclosure, the front header 32 defines an access port 62. The access port 62 provides access into the tank space 30A, which may be useful for cleaning or maintenance of the tank 30. The access port 62 may be covered by a releasably sealable door (not shown). In some embodiments of the present disclosure the rear header 34 defines one or more ports therethrough. For example, the rear header 34 may define a debris port (not shown) with a debris chute 66 and a releasably sealable debris-chute door 66A. The rear header 34 may also define an ancillary port 68 that is covered by a releasably sealable door (not shown). The ancillary port 68 may be used for visual inspection of the tank space 30A and/or to connect further tubes or pipes to the tank 30. The lower surface 31 may define one or more drain holes (not shown) each of which may be covered by a drain valve 60. The lower surface 31 may also include one or more mounting rails 62 for connecting the tank 30 to the vehicle 10.

In some embodiments of the present disclosure the front header 32 and the rear header 34 have a thickness between about ⅛ of an inch and about ½ of an inch (an inch is equivalent to about 0.0254 meters). In some embodiments of the present disclosure the middle section 33 has a thickness between about 1/16 of an inch and about 5/16 of an inch. In some preferred embodiments of the present disclosure the front header 32 and the rear header 34 have a thickness that is about ¼ of an inch and the middle section 33 has a thickness that about 3/16 of an inch thick. In these preferred embodiments of the present disclosure the tank may weigh about 3500 pounds. Decreasing the thickness of the middle section from ¼ of an inch to 3/16 of an inch may result in a decrease of about 400 pounds in total tank weight. A comparative tank that has a front header, a rear header and a middle section that all have a thickness of ½ of an inch weighs about 2400 pounds more than the preferred embodiments of the tank 30 described herein, with other dimensions and materials being substantially similar.

Figure 3:
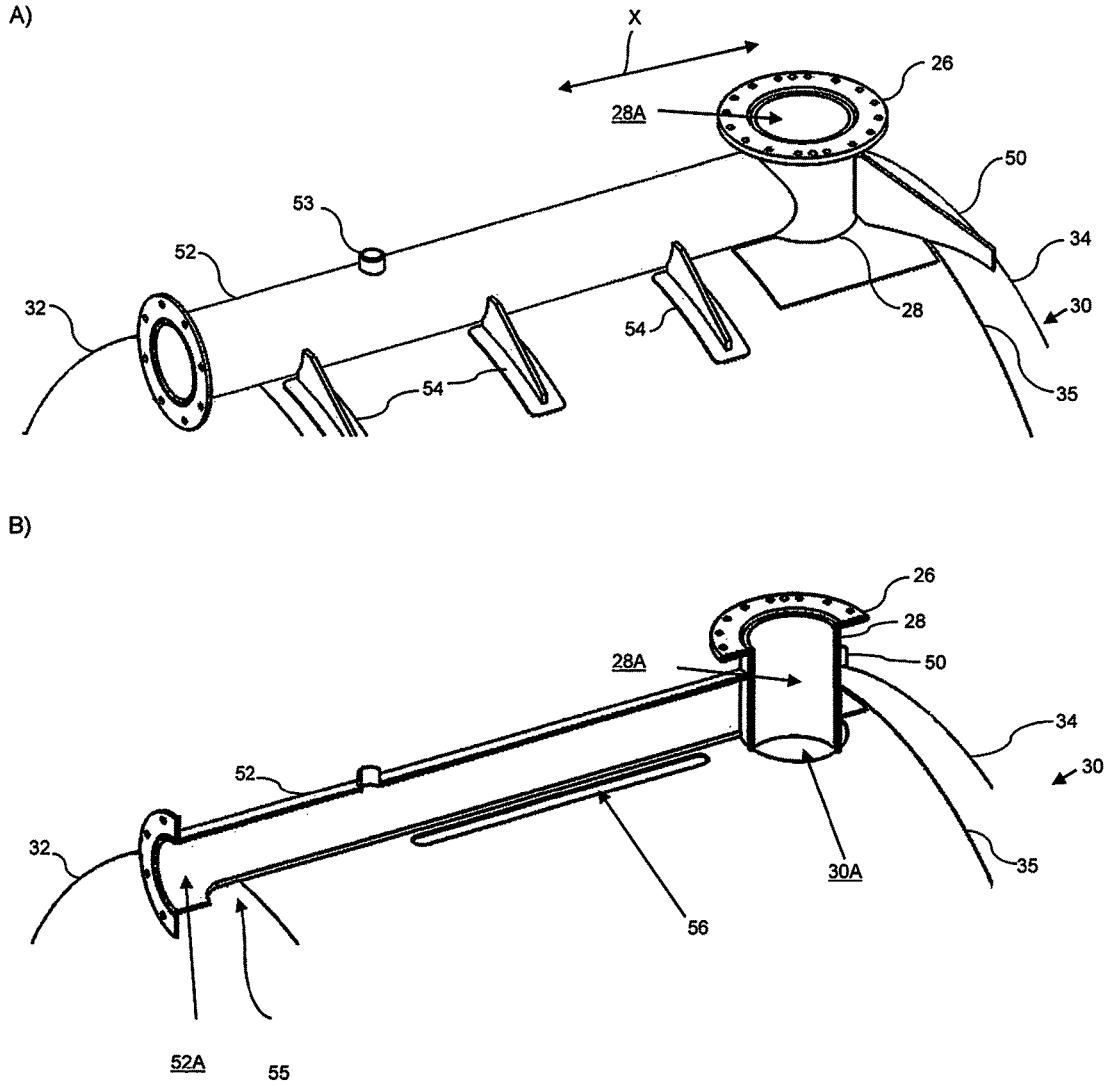
FIG. 3 is an isometric view of an upper portion of the tank shown in FIG. 2: A) shows one embodiment of a fluid evacuation tube that is coupled to the upper portion of the tank; B) shows a partial mid-line cross-sectional view of the portion of the tank.

FIG. 3A and FIG. 3B show an upper portion of some embodiments of the tank 30. The boom mount 28 extends upwardly from the upper surface 35. In some embodiments of the present disclosure the boom mount 28 is coupled to the upper surface 35 of the tank 30. As referred to herein, the terms "couple" and "coupling" may refer to the manner by which two components of the vacuum-excavation apparatus 11 can be physically joined together so that stress loads may be distributed between the coupled components or from one to the other. For example, coupling may occur by welding that provides a weld-bead height that is the same as or close to the thickness of the two components that are being coupled together. In some embodiments of the present disclosure, the two components that are being coupled together are not the same thickness, in which case the weld-bead height may be the same or close to the thickness of the thinner component, or not. For example, in some embodiments of the present disclosure, a weld-bead height of about ⅛ of an inch to about ½ of an inch is suitable for coupling, as described herein. In further embodiments of the present disclosure, a weld-bead height of about ¼ of an inch is suitable for coupling, as described herein. The boom mount 28 defines a boom mount aperture 28A that provides fluid communication through the upper surface 35 to the tank space 30A therebelow (see FIG. 3B). In the embodiment shown FIG. 3, the boom mount 28 has a mounting flange 26. The mounting flange 26 is connectible to the boom assembly 18 via one or more connection members (not shown) and the pivoting capability of the boom assembly 18 is achieved by the support arm 24 including a pivot member. However, as will be appreciated by those skilled in the art, the boom mount 28 may connect with the boom assembly 18 in various manners that don't require a mounting flange 26 but still permit pivoting movement of a connected boom assembly 18. In some embodiments of the present disclosure the boom assembly 18 may pivot by rotating about an axis that is substantially perpendicular to the longitudinal axis X of the tank 30. For example, the boom assembly 18 may rotate along a first plane that is substantially parallel to a rear axle of the truck 10 with about 300 to about 340 degrees of rotational freedom, when viewed from above. In some embodiments of the present disclosure the boom assembly 18 may also rotate above and below the first plane by about 30 degrees.

The boom mount 28 is coupled to the rear header 34 by one or more supporting members 50. In some embodiments the one or more supporting members 50 are coupled to both of the boom mount 29 and the rear header 34. The one or more supporting members 50 can also be referred to as struts or gussets. In the embodiment depicted in the appended figures two supporting members 50 are shown, however this is not intended to be limiting. The one or more supporting members 50 may be made of a rigid material, for example A36 steel, high-strength steel and aluminium. The one or more supporting members 50 can distribute at least a portion of a stress load that is imparted on the boom mount 28 to the tank 30 for example the rear header 34. The coupling of the boom mount 28 to the rear header 34 by the one or more supporting members 50 distributes a portion of a stress load that is imparted upon the boom mount 28 by a connected boom assembly 18 and/or movement thereof.

An evacuation tube 52 is coupled to the upper surface 35 of the tank 30. The evacuation tube 52 may also be referred to as an evacuation pipe, a suction tube and a suction pipe. The evacuation tube 52 defines an interior evacuation tube space 52A. The evacuation tube 52 provides fluid communication between the tank space 30A and the vacuum assembly 38. In some embodiments of the present disclosure, the upper surface 35 of the tank 30 defines an evacuation slot 56 therethrough (see FIG. 3B). The evacuation tube 52 also defines an evacuation tube slot 55. The evacuation tube slot 55 is in fluid communication with the evacuation slot 56. For example, the evacuation tube 52 may overlay a portion or all of the evacuation slot 56. This arrangement defines a fluid pathway from the tank space 30A, through the slots 52, 55 into the evacuation tube space 52A and onto the vacuum assembly 38.

The evacuation tube 52 also participates in distributing at least a portion of the stress loads that can be imparted on the boom mount 28 and the tank 30 by the boom assembly 18 and movement thereof. One end of the evacuation tube 52 is coupled to the boom mount 28. This coupling may distribute at least a portion of the stress loads that are imparted upon the boom mount 28 to the evacuation tube 52. In some embodiments of the present disclosure the tank 30 may also include one or more further support members 54 that are coupled to the middle section 33 and the evacuation tube 52, for example by welding. The one or more further supporting members 54 can also be referred to as struts or gussets. In the embodiment depicted in the appended figures three further supporting members 54 are shown, however this is not intended to be limiting. The one or more further supporting members 54 are made of a rigid material, for example steel. The one or more further supporting members 54 can distribute at least a portion of a stress load that is imparted on the evacuation tube 52 to the middle section 33 of the tank 30.

Figure 4:
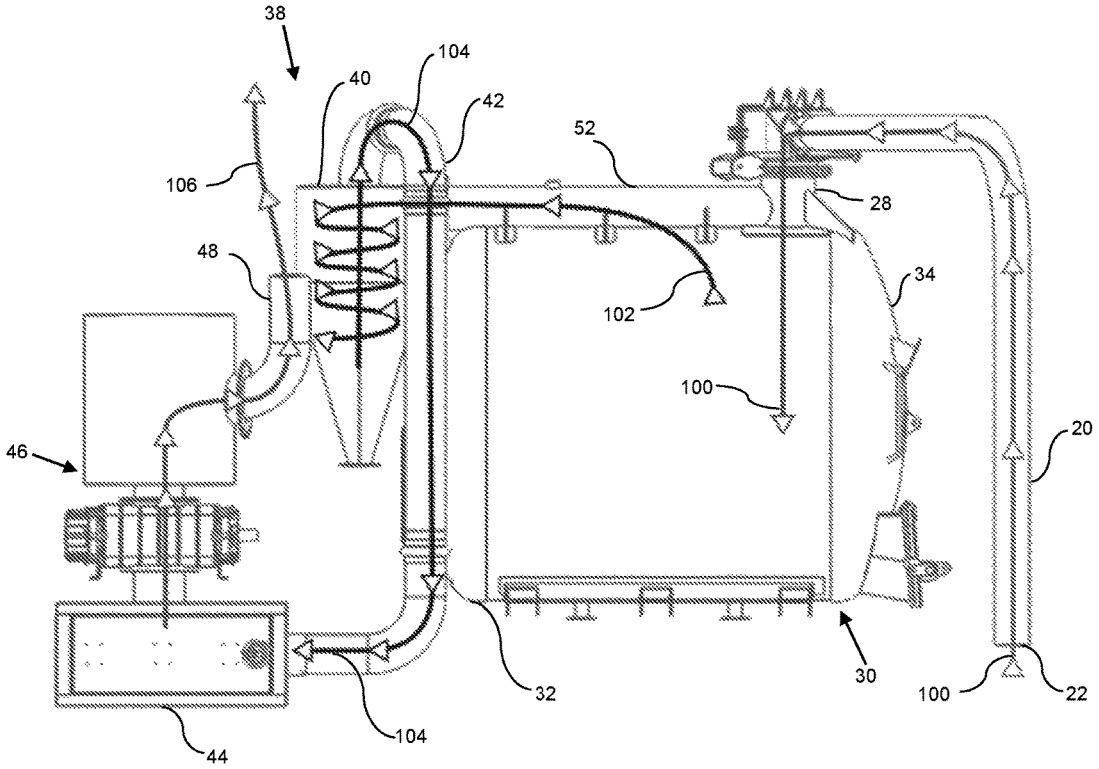
FIG. 4 is a side-elevation view of a vacuum assembly according to one embodiment of the present disclosure.
Figure 5:
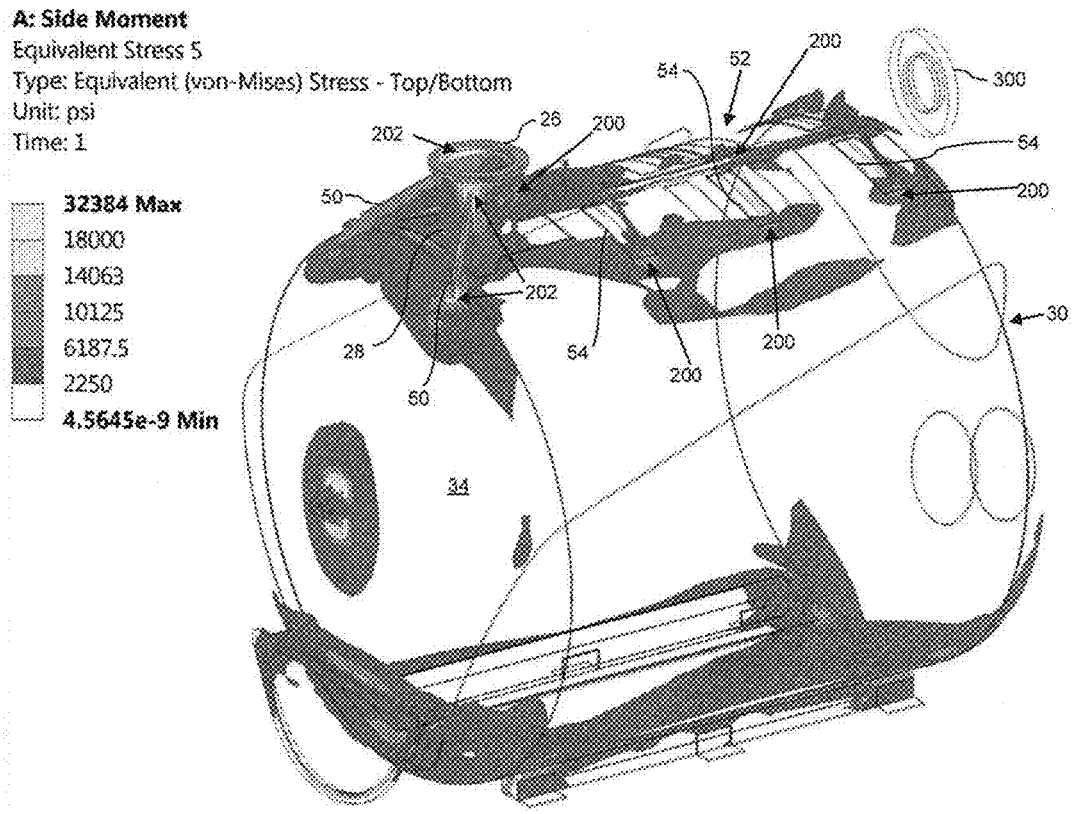
FIG. 5 includes example images of stress-load data that were obtained from a computer software model.

As shown in FIG. 4 the evacuation pipe is physically and fluidly connected to the vacuum assembly 38. FIG. 5 shows a vacuum-assembly flange 300, which is where the evacuation tube 52 physically and fluidly connects to the vacuum assembly 38. The components of the vacuum assembly 38 are known and include one or more cyclones 40. The cyclones 40 direct a flowing evacuation stream 102 into a circular pattern which separates out at least a portion of any debris materials from within the evacuation stream 102. The vacuum assembly 38 also includes a conduit 42 that that fluidly communicates a cyclone-output stream 104 to one or more filters 44. The one or more filters 44 remove further debris materials from the cyclone-output stream 104. A filter-output stream 106 then passes through one or more vacuum blowers 44 to form an exhaust stream 106 that exist the vacuum-excavation apparatus 11 by an exhaust port 48. The one or more vacuum blowers 44 may include a silencer mechanism, or not.

In operation, the one or more vacuum blowers 44 generate a pressure differential that drives the flow of fluids and any debris materials entrained therein from the input end 22 to the exhaust port 48. The pressure differential creates a suction force at the input end 22 of the vacuum tube 20. A pressurized fluid, either a gas or liquid, is directed at the material to be excavated to generate a stream of fluidized debris-material 100. The debris material becomes fluidized, even if only temporarily, in that the debris material is loosened from the surround materials and it can become airborne or otherwise drawn into the input end 22 by the suction force. The stream of fluidized debris-material 100 includes air and the fluidized debris-material, all of which are conducted through the vacuum tube 20 into the tank 30. Within the tank 30 at least a portion of the debris material will settle out of the first stream 100 to create the evacuation stream 102 that has a lower debris-material content than the stream of fluidized debris-material 100. Under the influence of the pressure gradient created by the one or more vacuum blowers 44, the evacuation stream 102 passes through the slots 55, 56 into the evacuation tube 52 for conduction to the vacuum assembly 38. The evacuation stream 102 is processed in the vacuum assembly 38 as described above.

As the input end 22 is moved about the vehicle 10 to draw more debris material into the stream of fluidized debris-material 100, the boom assembly 18 can pivot about the boom mount 28. This pivoting imparts stress loads on the boom mount 28. Due to the coupling of the evacuation tube 52 and the one or more support members 50 to the boom mount 28, at least a portion of the stress load are distributed to the middle section 33 and the rear header 34 of the tank 30. This stress load distribution allows a greater surface area of the tank 30 to bear portions of the stress loads. This may reduce or avoid focusing the stress-loads moments on smaller areas of the tank 30, which smaller areas could be susceptible to stress failures. As described above, the stress load distribution allows portions of the tank 30, for example the middle section 33, to be made with thinner walls than a typical vacuum-truck tank, which reduces the overall weight of the vacuum-excavation apparatus 11.

FIG. 5 shows examples of stress-load finite element analysis data that were calculated using the ANSYS® simulation software (ANSYS is a registered trademark of SAS IP Inc.). The calculated stress-load data was superimposed over a wire diagram of the tank 30. For these calculations the total vertical-load applied was about 2050 lbf and the applied moment was 2e5 inch-lbf with the boom assembly 18 positioned off one side of the tank 30 (to the left of the tank 30 when viewed looking straight at the rear header 34) so that the direction of the moment was applied at least at the mounting flange 26. Points of stress 200 are shown in FIG. 5 where the calculated stress load values range between about 6750 pounds per square inch (psi) to about 11250 psi (one psi is equivalent to about 6.89 kilopascal). Points of higher stress 202 are also shown in FIG. 5 where the calculated stress-load values are between about 11250 psi to about 32384 psi. The data analysis indicated that there are no points of stress 200 or points of further stress 202 occurring at the vacuum-assembly flange 300.

FIG. 5 also shows that there are points of stress 200 at least where the support members 54 terminate on the middle section 33 of the tank 30 (distal from the evacuation tube 52). There are also points of stress 200 where the evacuation tube 52 is coupled to the boom mount 28 and along the longitudinal axis of the tank 30 where the evacuation tube 52 is coupled to the upper surface 35. There are further points of stress 200 proximal to where the support members 50 are coupled to both of the rear header 34 and the boom mount 28. FIG. 5C shows that there are points of stress 200 at least along lateral sides of the support members 50, at the point where the boom mount 28 is coupled to the upper surface 35 and between the upper surface 35 (in the middle section 33) and an upper portion of the rear header 34. FIG. 5C also shows that there are points of higher stress 202 on the mounting flange 26, the inner surface of the boom mount 28 (on the side where the boom assembly is extending from), at the points where the support members 50 are connected to the boom mount 28 and the rear header 34 and along an upper surface of the support members 50.

Without being bound by any particular theory, the stress-load data indicates that the stress loads that are imparted upon the boom mount 28 by a connected boom assembly 18 are at least partially distributed to the rear header 34, the evacuation tube 52, the support members 50, the further support members 54 and the middle section 33.

In some embodiments of the present disclosure the evacuation tube 52 includes a pressure-relief valve 53 that when opened provides fluid communication between the evacuation tube space 52A and the surrounding atmosphere. When closed the pressure-relief valve 53 provides a fluid-tight seal.

In some embodiments of the present disclosure, the vacuum-excavation assembly 11 may be used to move liquids from a reservoir, such as a hole or tank, into the tank 30 for storage and transport of the liquids.

We claim:

1. A vacuum-excavation apparatus that is connectible to a vehicle, the vacuum-excavation apparatus comprises:

(a) a vacuum tube with an input end;

(b) a vacuum assembly for generating a suction force at the input end and drawing a stream of fluidized debris-material into the vacuum tube;

(c) a boom assembly for supporting the vacuum tube;

(d) a tank for receiving the stream of fluidized debris-material from the vacuum tube, the tank providing a boom mount for pivotally connecting the boom assembly and for providing fluid communication between the vacuum tube and the tank; and (e) an evacuation tube for providing fluid communication between the tank and the vacuum assembly and for distributing at least a portion of stress-loads that are generated by the boom assembly, wherein the tank has an upper surface that defines an evacuation slot therethrough and wherein the evacuation tube defines an evacuation-tube slot that at least partially overlays the evacuation slot to provide the fluid communication between the tank and the evacuation tube.

2. The vacuum-excavation apparatus of claim 1, further comprising one or more support members for distributing at least a portion of the stress-loads to a rear header of the tank.

3. The vacuum-excavation apparatus of claim 1, further comprising one or more further support members for distributing at least another portion of the stress-loads to a middle section of the tank.

4. The vacuum-excavation apparatus of claim 1, wherein the tank further comprises a front header, a rear header and a middle section therebetween, the front header and the rear header each have a wall thickness of between about an ⅛of an inch and about ½ of an inch and the middle section has a thickness that is between about 1/16 of an inch and about 5/16 of an inch.

5. The apparatus of claim 1, wherein the evacuation tube is coupled to the tank and the boom mount.

6. The vacuum-excavation apparatus of claim 1, wherein the vehicle has a single rear-axle.

7. A tank comprising:

(a) a front header, a rear header and a middle section therebetween, all of which define an interior space of the tank;

(b) a boom mount coupled to an upper surface of the tank, the boom mount for pivotally connecting a boom assembly and for defining a boom-mount aperture that provides fluid communication through the upper surface into the interior space of the tank; and (c) an evacuation tube that is coupled to the upper surface and the boom mount, the evacuation tube defines an evacuation-tube slot that at least partially overlays an evacuation slot in an upper surface of the middle section for providing the fluid communication between the tank and the evacuation tube, wherein when a boom assembly is pivotally connected to the boom mount pivoting of the boom assembly generates stress loads on the boom mount and the evacuation pipe distributes at least part of the stress loads to the middle section of the tank.

8. The tank of claim 7, further comprising one or more support members that are coupled to the boom mount and the rear header.

9. The tank of claim 7, further comprising one or more further supports that are coupled to the evacuation pipe and the middle section of the tank.

10. The tank of claim 7, further comprising mounting rails on a lower surface of the tank for connecting the tank to a vehicle with a single rear-axle.

11. The tank of claim 10, wherein the evacuation pipe is in fluid communication with a vacuum assembly that is connected to the vehicle.

12. The tank of claim 11, wherein the front header and the rear header each have a wall thickness of between about an ⅛ of an inch and about ½ an inch and the middle section has a thickness that is between about 1/16 of an inch and about 5/16 of an inch.

* * * * *